US006454110B1

(12) United States Patent
Takeuchi et al.

(10) Patent No.: US 6,454,110 B1
(45) Date of Patent: Sep. 24, 2002

(54) BIAXIAL STRETCHING BOTTLE HAVING CARRYING HANDLE

(75) Inventors: Setsuyuki Takeuchi; Nobukuni Ibe; Yukio Yanagimachi, all of Nagano-ken (JP)

(73) Assignee: A. K. Technical Laboratory, Inc., Nagano-Ken (JP)

( * ) Notice: Subject to any disclaimer, the term of this patent is extended or adjusted under 35 U.S.C. 154(b) by 0 days.

(21) Appl. No.: 09/743,977

(22) PCT Filed: May 18, 2000

(86) PCT No.: PCT/JP00/03202

§ 371 (c)(1),
(2), (4) Date: Jan. 17, 2001

(87) PCT Pub. No.: WO00/71432

PCT Pub. Date: Nov. 30, 2000

(30) Foreign Application Priority Data

May 19, 1999 (JP) ..... 11-138965
Oct. 29, 1999 (JP) ..... 11-310025

(51) Int. Cl.[7] ..... B65D 1/02
(52) U.S. Cl. ..... 215/398; 220/771
(58) Field of Search ..... 215/398, 396; 220/771, 773; 244/31.2

(56) References Cited

U.S. PATENT DOCUMENTS 3,000,527 A 9/1961 Jennings et al.
3,285,454 A * 11/1966 Bailey ..... 215/398 X
3,307,752 A * 3/1967 Anderson ..... 215/398 X
3,441,172 A * 4/1969 Dike ..... 215/398 X
3,481,501 A * 12/1969 Anderson ..... 215/398
4,395,378 A * 7/1983 Alberghini et al. ..... 215/398 X
5,704,507 A * 1/1998 Krall et al. ..... 215/398
5,862,929 A * 1/1999 Takeuchi et al. ..... 215/398
6,227,393 B1 * 5/2001 Takeuchi et al. ..... 215/398

FOREIGN PATENT DOCUMENTS

EP 0 732 187 A1 9/1996
EP 0 856 472 A2 8/1998
JP 49-137953 11/1974
JP 10-218190 A 8/1998

* cited by examiner

*Primary Examiner*—Nathan J. Newhouse
*Assistant Examiner*—Tri M. Mai
(74) *Attorney, Agent, or Firm*—Weingarten, Schurgin, Gagnebin & Lebovici LLP

(57) ABSTRACT

A biaxial stretching bottle in which a pair of carrying handles are provided oppositely constituted on both sides of a neck portion in such a manner as to be bent freely, and the biaxial stretching bottle having the carrying handle with a structure which can improve durability strength of a base portion and a connection structurally. A pair of U-shaped carrying handles, which a handle grip portion and an arm portion of both sides are formed integrally, are connected to and formed on both ends of the base portion constituted by overhang pieces formed on the symmetrical positions of both sides of the neck portion. Brackets are constituted unitarily across the lower surface of the vicinity of both ends of the base portion and a side surface of the neck portion and stoppers are projected and arranged on the upper surface of the base portion.

3 Claims, 5 Drawing Sheets

BIAXIAL STRETCHING BOTTLE HAVING CARRYING HANDLE

FIELD OF THE INVENTION

This invention relates to a biaxial stretching bottle having a carrying handle and more particularly to a biaxial orientation bottle which a pair of U-shaped carrying handles are formed on both sides of a neck portion of the bottle.

BACKGROUND OF THE INVENTION

There has been a bottle with the carrying handle as disclosed in WO Patent Publication 082/02969 as a biaxial orientation bottle with a polyester resin which is typified by a PET bottle. This bottle with the carrying handle has an oblong carrying handle which is molded integrally on one side of the neck portion when injecting a preform. The carrying handle is bent from a connection region by a load of the bottle which contents are filled and the bottle can be held in the condition of hanging.

Polyester resin is lacking in flexibility, differing from a polypropylene resin or the like. For this reason, there has been a problem that since it is not bent conveniently by the load of the bottle, it is hard to carry the bottle in the hand perpendicularly.

There has been known the bottle with the carrying handle disclosed in Japanese Laid-open Patent Publication No. Hei. 218190 (Europe Laid-open Patent Publication 0856472) as means for solving such problem. A base portion constituted by an overhang piece is formed on a symmetrical position of both sides of the neck portion of this bottle. The U-shaped carrying handle which a handle grip portion and an arm portion of the both sides are formed integrally is molded integrally and continuously on one end of the base portion. The carrying handle is provided longer than a distance (height) between the base portion and an opening of the neck portion across the sideward. Moreover, fluidized-orientation is given on the resin to be molded by molding the boundary of the arm portion and the base portion in a thinned-wall as a narrowing portion, and the carrying handle is designed to be able to pivot upwardly and downwardly from a boundary.

The bottle can be held in the condition of hanging approximately perpendicularly, since the carrying handle is bent naturally from the thinned-wall connection by the load of the bottle and the arm portion is pivoted upwardly to change the direction of the carrying handle in the longitudinal direction, even though the carrying handle is directed transversely when grasping the carrying handle of this bottle with the carrying handle to lift up the bottle. Moreover, the load at carrying in the hand would be concentrated on the connection strengthened by fluidized-orientation of resin molecules. Therefore, even though the base portion is of a non-orientated-plate shape, it can withstand to a certain measure of load. For example, even though being the bottle of the degree of approximately three liters, it can not be damaged due to the load.

However, even though it becomes possible to carry in the hand the bottle approximately perpendicularly, it is provided with only one thin-plate shaped carrying handle, moreover, the handle grip portion which fingers of a hand of a user are hooked has no sufficient thickness. For this reason, the problem would be caused that the handle grip portion comes to dig into the fingers of the hand to feel a pain in carrying due to the load in the case of the bottle with the carrying handle of a large-size of more than five liters, so that carrying can not be performed unless otherwise holding in and lifting up the bottle in a halfway.

Such problem can be solved by forming a pair of U-shaped carrying handles which the handle grip portion and the arm portion of the both sides are formed integrally and are molded integrally on one end of the base portion on the symmetrical positions of the both sides of the neck portion. A pair of carrying handles rising-up on the both sides of the neck portion in such a manner as to be bent upwardly allow to place the fingers of the hand into both grasp portions to grasp the bottle. Therefore, the burden can be lightened and easy to hold than the case according to the carrying handle formed on only one side of the neck portion.

On the other hand, even though the load due to the contents by upsizing of the bottle is increased, the bending strength of the connection on which fluidized-orientation is given is large unexpectedly, and the connection can not be broken easily unless otherwise bending more than required. However, the base portion becomes easy to deform due to the increased load, in addition, to tend to be damaged easily. Since the connection is strong also against a tensile force, the tensile stress is concentrated on the both ends of the base portion and to bend the base portion upwardly from the central. This causes deflection of the base portion, and it becomes unbearable with the base portion made of polyethyleneterephthalate of approximately 1.4 mm in thickness, when this is repeated. Therefore, deflection and breakage of the base portion should be prevented by means of any means in the large-sized bottle of the degree of approximately ten liters.

DISCLOSURE OF THE INVENTION

This invention is devised for solving the described-above problem, and the object is to provide a biaxial stretching bottle having a new carrying handle capable of adopting also in the large-sized bottle of the degree of approximately ten liters which has been hard to adopt heretofore without changing the structure of the carrying handle drastically by increasing durability strength of the base portion and the connection.

This invention devised for the object described above provides a biaxial stretching bottle having a carrying handle, said bottle comprising:

a neck portion;

a trunk and a bottom which a biaxial stretching is given in a thinned-wall from a lower end of the neck portion;

a pair of base portions formed with a horizontal overhang piece formed in such a manner to project the both ends at a symmetrical position of a side surface of the neck portion; and a pair of carrying handles formed in such a manner to connect with one end each of the base portions and provided on a side of the neck portion, wherein said carrying handle is constituted by a handle grip portion molded integrally and arm portions of the both sides, a plane shape is a form of U-shape, the carrying handle is molded integrally with the neck portion when injecting a preform and is used as a carrying handle of the bottle as it is, said arm portion is longer than a distance from the base portion to an opening of the neck portion, and the respective arm portion of the carrying handle is connected to one end of each of the corresponding base portions, whereby the carrying handle is provided long in the sideward and across the both sides of the neck portion inwardly, here, a connection region of said base portion and arm portion is provided with a thinned-wall connection with a required length, said pair of carrying handles are constituted on the both sides of said neck portion in such a manner as to be bent freely longitudinally, and a pair of brackets are constituted across the lower surface of the vicinity of both ends of said respective base portion and a side surface of the neck portion, thereby to be prevented the base portion from deforming and breaking.

According to the invention, even though carrying the bottle in the hand by using the carrying handle repeatedly, the base portion cannot be deformed due to deflection and can withstand to the load. The structure of the part of this carrying handle also can be applied for a large-sized bottle, for example, a largesized PET bottle of approximately ten liters, and in this case, the carrying handle cannot be broken from the connection due to the load, and the bottle cannot be dropped out due to breakage of the base portion while carrying in the hand.

Moreover, the load loaded on the fingers of the hand of the user also can be shared between the respective carrying handle by grasping a pair of carrying handles.

Moreover, in such biaxial stretching bottle with the carrying handle, the bottle can be carried in the hand, bringing a pair of carrying handles on the both sides of the neck portion together, and can be conveyed in the condition that two persons hold the carrying handle by one side, if required.

Moreover, a bracket undergoes the tensile force which acts on the base portion at carrying in the hand. Therefore, it can withstand to the load sufficiently without causing deformation due to deflection, even though the base portion is constituted by the overhang piece.

Moreover, in this invention, the upper surface of the vicinity of the connection of said base portion is preferably provided with a stopper constituted by a projection for limiting for the respective carrying handle to go beyond the neck portion to position at the bending position of the opposite side, which is constituted by bending of the carrying handle in such a manner to be in contact with the upper surface of said arm portion. In some cases, the upper surface of the arm portion of the vicinity of the connection of said base portion is preferably provided with a stopper constituted by a projection for limiting for the respective carrying handle to go beyond the neck portion to position at the bending position of the opposite side, which is constituted by bending of the carrying handle in such a manner to be in contact with the upper surface of said base portion.

Since a limitation for a bending range of the carrying handle is provided by blocking an excessive bending of the carrying handle by means of the stopper projected and arranged on the upper surface of the arm portion of the base portion or the carrying handle, deterioration of a bending strength of the thinned-wall connection which tends to be caused when the handle grip portion is bent up to the opposite side beyond the neck portion also can be prevented. According to this constitution, the life time of the connection is extended, and it becomes possible to use repeatedly over the long term.

PREFERRED EMBODIMENTS OF THE INVENTION

Figure 1:
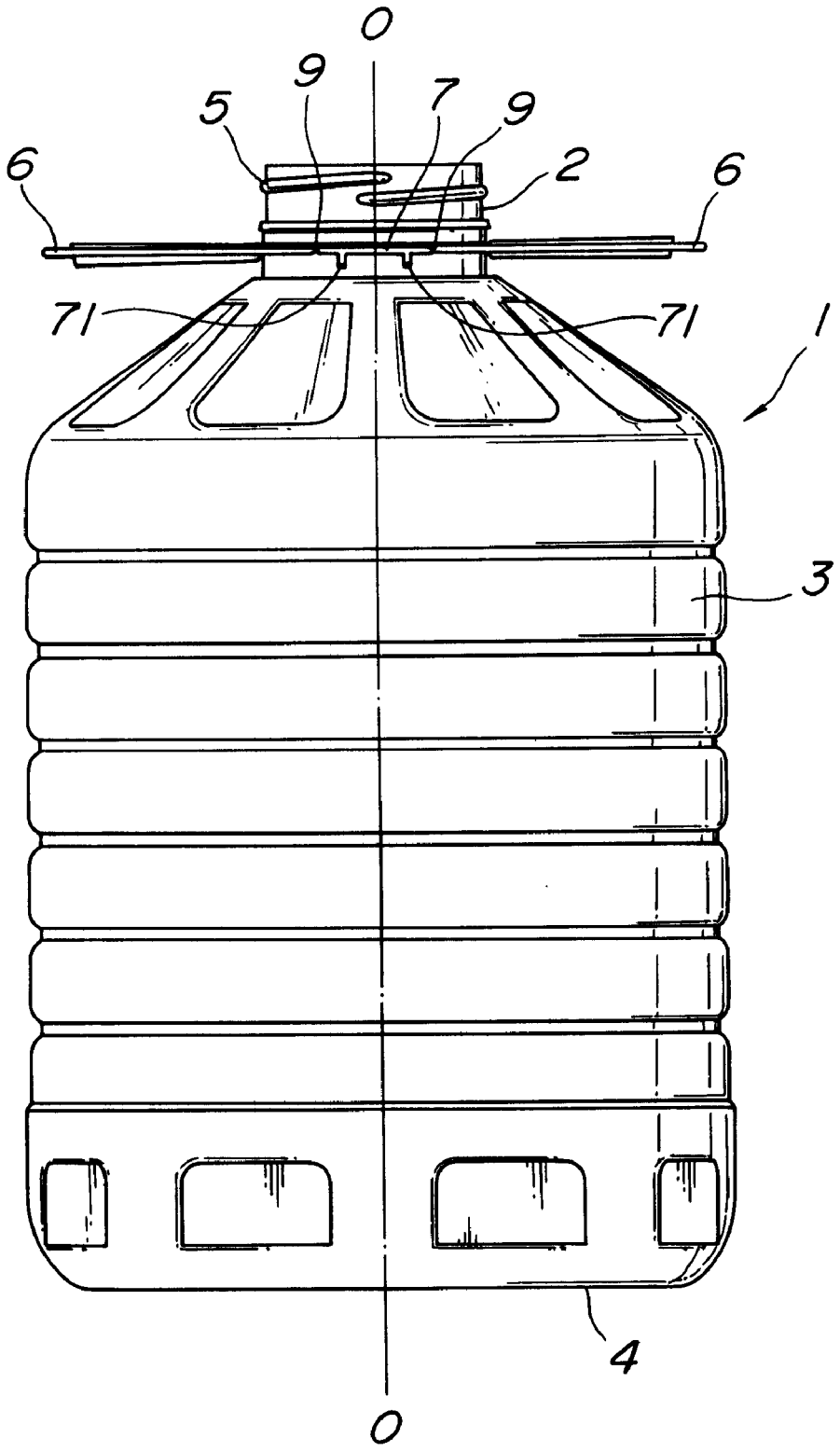
FIG. 1 is a front elevation of one embodiment of a biaxial stretching bottle having a carrying handle according to the invention.

The invention will be described with reference to FIG. 1 to FIG. 8 in detail.

A reference symbol 1 is a bottle with a circular trunk made of a thermoplastic resin or the like. Polyester resin, for example, polyethyleneterephthalate is given as the thermoplastic resin. A bottle 1 is constituted by a neck portion 2, a trunk portion 3, and a bottom 4. The trunk portion 3 from the lower end of the neck portion 2 are formed by a stretching blow-molding in a thinned-wall. A screw 5 is formed on the outer periphery of the neck portion, and a pair of carrying handles 6 and 6 are formed on the side of the neck portion of the lower side from the screw 5.

Figure 2:
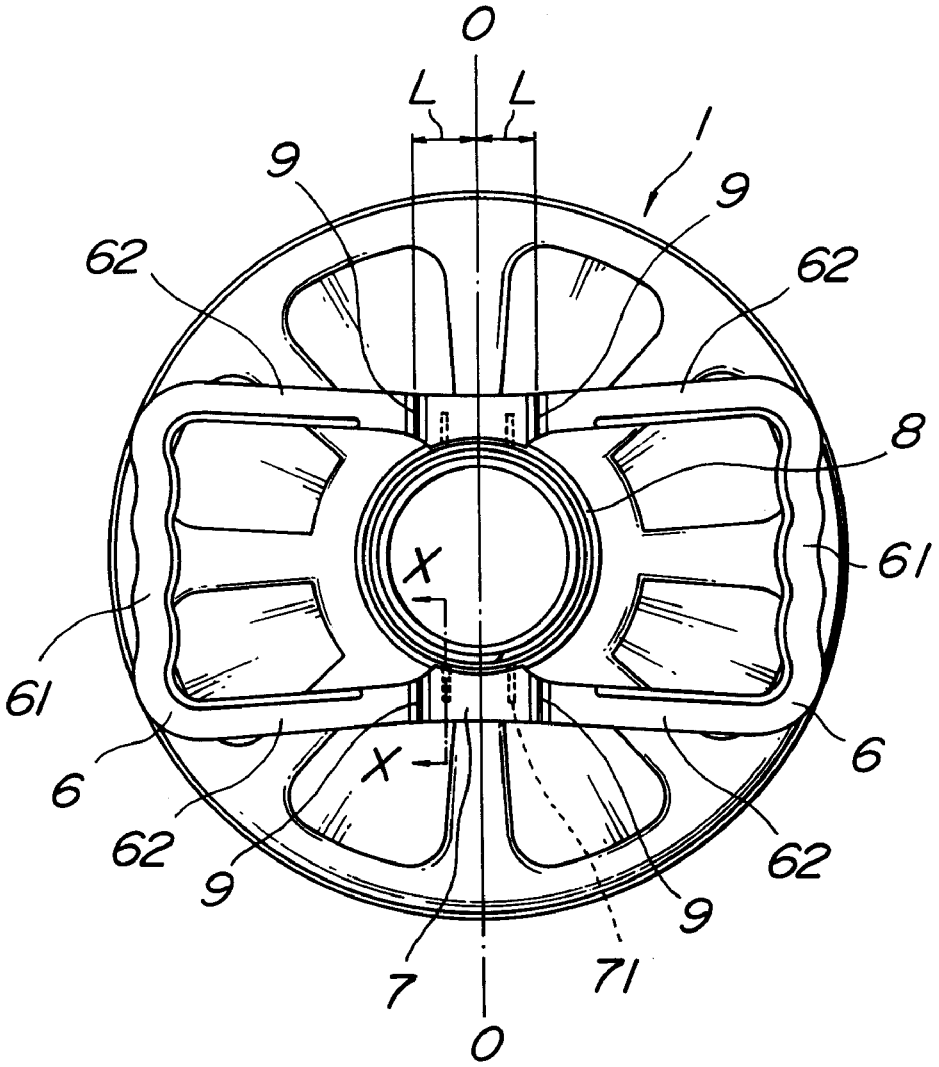
FIG. 2 is a top plane view of a bottle shown in FIG. 1.
Figure 3:
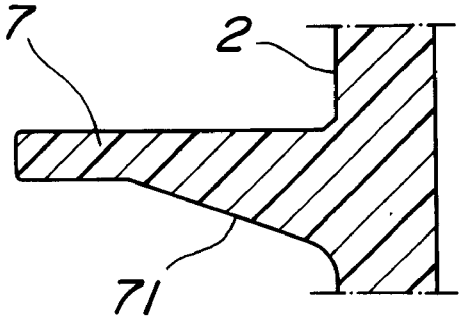
FIG. 3 is a sectional view along line X—X in FIG. 2.
Figure 4:
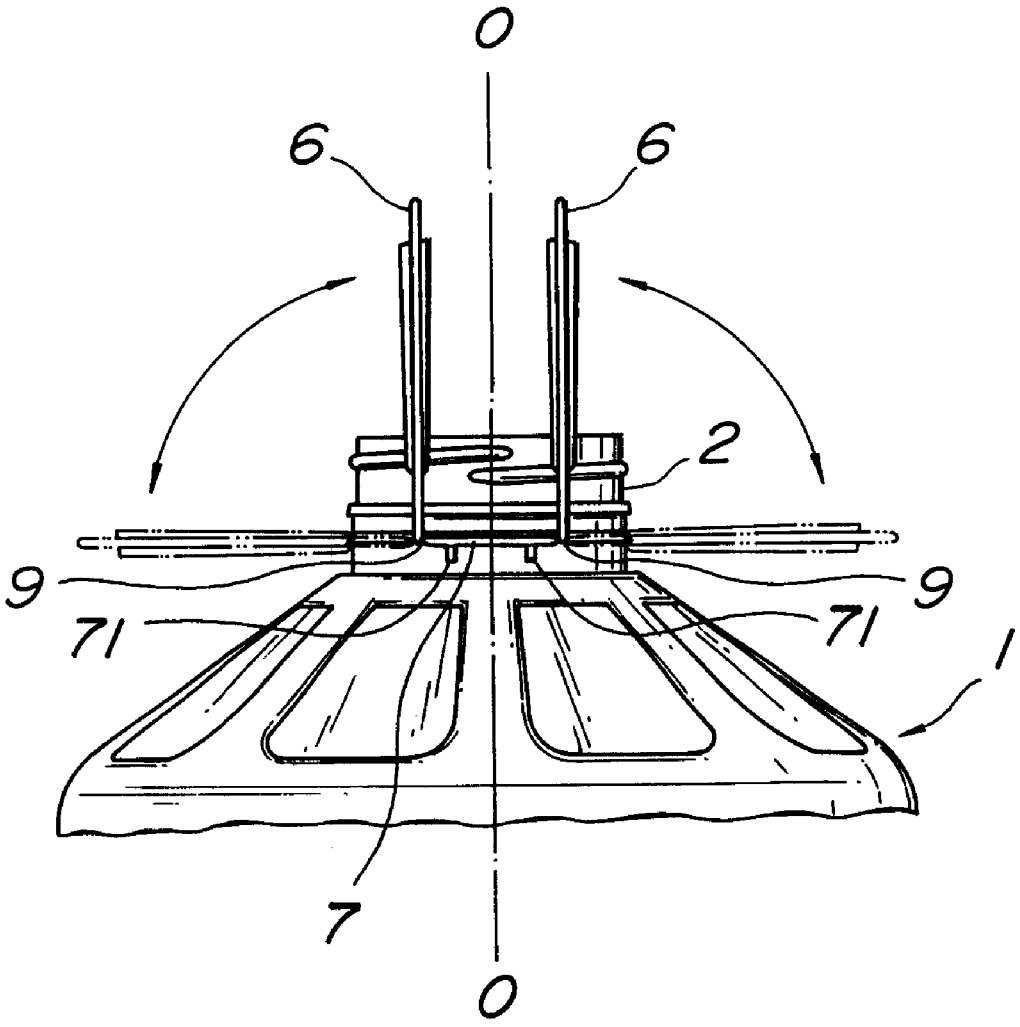
FIG. 4 is a front elevation of an upper of a bottle showing a condition rising-up a pair of carrying handles on the both sides of the neck portion by bending from the connection.
Figure 5:
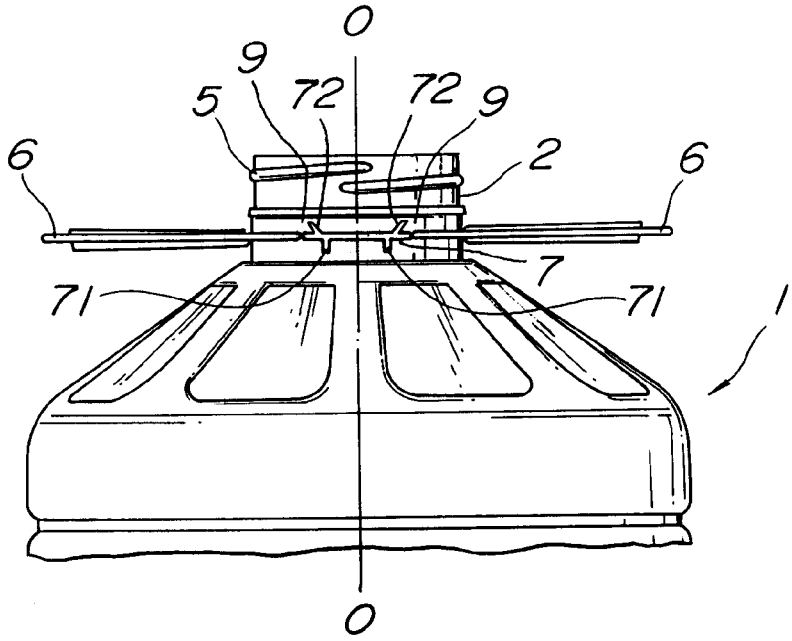
FIG. 5 is a front elevation of an upper of the bottle of another embodiment having a stopper according to the invention.
Figure 6:
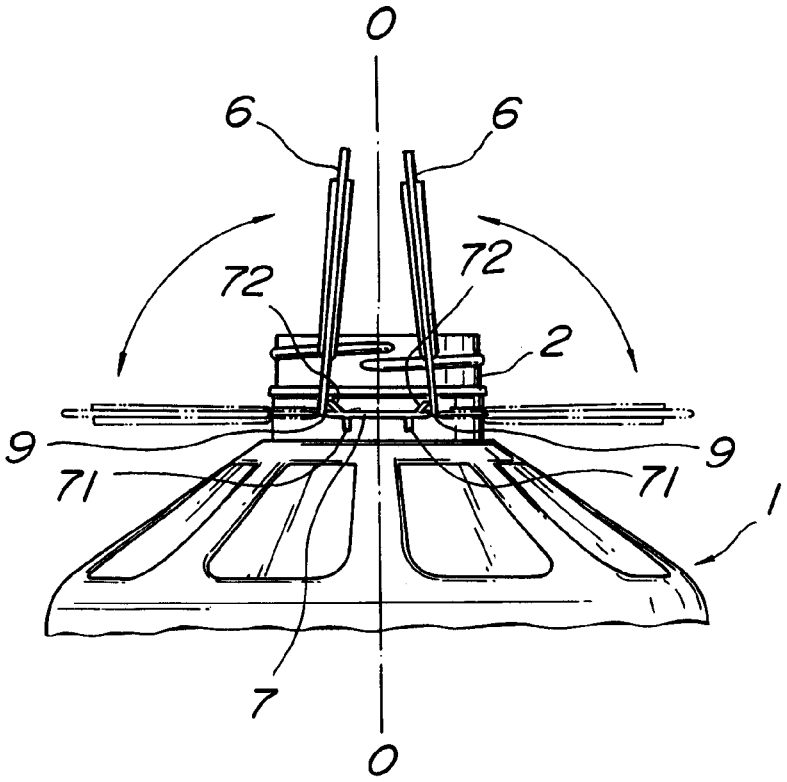
FIG. 6 is a front elevation of an upper of a bottle showing a condition rising-up a pair of carrying handles shown in FIG. 5 on the both sides of the neck portion by bending from the connection.

The carrying handles 6 are molded integrally with the neck portion 2 when injecting a preform and are used as a carrying handle 6 of the bottle 1 as it is. The carrying handles 6 are formed widely in width at the inner edge as shown in FIG. 1 and FIG. 2. Moreover, the carrying handle 6 has a form of flat U-shape, which is formed unitarily in the flat form with an elongate-plate body.

Base portions 7 and 7 constituted by a horizontal overhang piece formed in a manner to projecting the respective both ends are formed on symmetric positions of the sides of the front and the back of the neck portion 2. The described-above arm portions 62 and 62 are longer than a distance (height) from the base portions 7 and 7 to an end of an opening of the neck portion. Moreover, arm portions 62 and 62 are connected and formed integrally one with an end of the respective base portions 7 and 7. According to this constitution, the carrying handle 6 is provided long in the sideward and inwardly across both sides of the neck portion 2.

The described-above base portions 7 and 7 are overhung and formed widely in width in a direction of the radius from an annular ring 8 projected and formed in an outer peripheral of the neck portion 2 and in the same thickness as the described-above arm portion 62. Moreover, the annular ring 8 may be combined with a support ring and may be formed as another ring on the lower from the support ring.

The connection of a thinned-wall is formed on a boundary region of the base portion 7 and the arm portion 62. These connections 9 are formed with a required width (approximately 5mm in this embodiment) such that the arm portion 62 is allowed to rise up on the side surface of the neck portion. Moreover, here, fluidized-orientation is given on resin molecules, thereby being designed to be bent freely. These connections 9 are formed so as to being in parallel each other with a predetermined-spacing dimension L from a center line O—O (a symmetrical axis of the base portion 7 of one side) of the bottle.

According to this constitution, a pair of above-mentioned carrying handles 6 and 6 of both sides of the neck portion can be bent upwardly from the both ends to the same height, locating the base portion 7 and 7 of both sides at a center and, taking the connection 9 as a pivotal axis. Moreover, the carrying handles 6 and 6 can be grasped to carry the bottle 1 in the hand perpendicularly by bringing together the described-above handle grip portions 61 and 61 each other at the described-above center line O—O of the bottle of the upper of the neck portion to insert the fingers of the hand into the both handle grip portions.

The base portion 7 itself is formed with an overhanging piece limited in the thickness. For this reason, the load of the contents concentrates on both ends of the base portion when carrying a pair of carrying handles 6 and 6 in the hand, and the base portion 7 becomes easy to deflect and to deform or to be broken due to a tensile force caused therein. A bracket 71 is formed unitarily across the lower surface and the side surface of the neck portion of the both ends, which are symmetrical positions of said center line of each base portion 7 in order to prevent this.

A wall thickness of this bracket 71 is at least same as the wall thickness of the base portion, and according to this constitution, deflection of the base portions 7 and 7 due to stress concentration can be prevented against the tensile force from the side of the carrying handle 6. The brackets are formed at the vicinity of each connection 9 to each base portion 7 as shown in drawings, and are formed at two points of each base portion 7. According to this constitution, the base portion 7 can not be deformed every time even though carrying the bottle 1 in the hand repeatedly by using the carrying handles 6 and 6, and becomes possible to withstand to the load. Therefore, the structure the portion of this carrying handle 6 also can be applied to the large-sized bottle of five liters, further ten liters.

Moreover, the load loaded on the fingers of the hand of the user also can be shared between two parts because of grasping a pair of carrying handles 6 and 6. Therefore, the burden to the fingers of the hand is lightened, and it becomes possible to hold for a long time, even though the handle grip portions 61 and 61 are narrow in width.

Carrying in the hand of the bottle by using these carrying handles 6 and 6 can be performed in the condition that two persons hold the handle grip portions 61 and 61 from the both sides of the bottle by one side. In such case as described above, since the brackets 71 and 71 are resistant to the tensile force, deformation of the base portions 7 and 7 can be prevented.

As described above, an influence of the load upon the base portion 7 can be released by the brackets 71 and 71. On the one hand, even though the bending strength is added to the connection 9 with the thinner wall than the carrying handle 6 and the base portion 7 by fluidized-orientation of resin molecules when injection molding, there is limitation in the bending. Specifically, when being bent up to the condition as the connection 9 is folded in two by force, it become easy to be broken.

Figure 7:
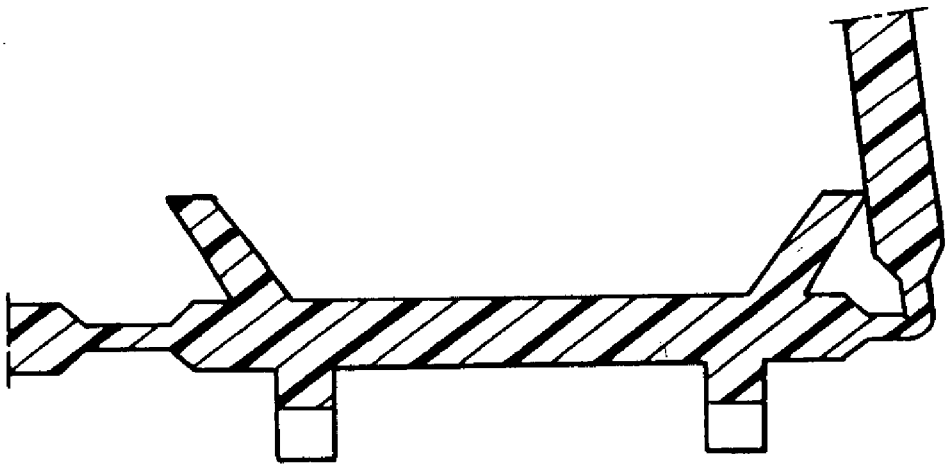
FIG. 7 is an enlarged longitudinal sectional view of component parts of the bottle according to the invention, the bottle having the stopper shown in FIG. 5.

Accordingly, in this invention, stoppers 72 and 72 catching the described-above arm portion 62 at bending of the carrying handle 6 are projected and arranged on the both ends of the upper surface of the base portion 7 in order to prevent such excessive bending as shown in FIG. 7. The stoppers 72 and 72 are preferably projected and arranged at the position of the upper surface of the base portion 7 of the outside than the described-above bracket 71 outwardly, and the tip is preferably projected and arranged in such a manner to being inclined to the extent being positioned at the upper of the end of the connection 9 as shown in the drawings.

Figure 8:
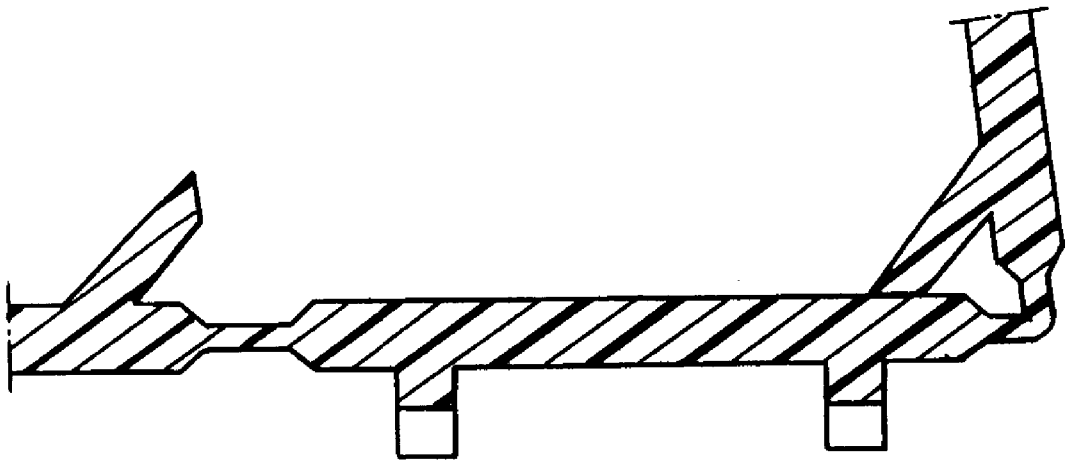
FIG. 8 is an enlarged longitudinal sectional view of component parts of the bottle of further another embodiment, the embodiment being provided with the stopper according to the invention on a side of the carrying handle.

FIG. 8 shows the case that the stopper 63 is projected and arranged on the upper surface of the described-above arm portion 62, and the stopper 63 is projected and arranged at the position of the upper surface of the arm portion 62 of the vicinity of the connection 9 and is projected and arranged in such a manner to being inclined opposed to the described-above stopper on the base portion inwardly. The tip of the stopper comes in contact with the upper surface of the base portion 7 at the more outside position than the bracket 71 by bending the carrying handle 6.

A bending angle at the connection 9 is limited within the range of rising-up the carrying handles 6 to grasp in a manner to bring the handle grip portions 61 and 61 of the carrying handles 6 and 6 together by projecting and arranging the described-above stopper 72 or 63 and it becomes impossible to bend beyond this angle. Therefore, breakage caused by deterioration in a bending strength of the connections 9 and 9 due to excessively bending can be prevented, and it becomes possible to withstand to repetitive use sufficiently.

Applicability in the Industry

According to the invention, the biaxial stretching bottle having the carrying handle with the described-above structure which can improve durability strength of the base portion and the connection and is adoptable also in the large-sized bottle of the degree of approximately ten liters can be provided and the problems can be solved without changing the structure of the carrying handle by a large amount. Moreover, breakage of the connection at bending the carrying handle can be prevented, and it becomes possible to use repeatedly by providing the stopper.

What is claimed is:

1. A biaxial stretching bottle having carrying handles, said bottle comprising:

a neck portion;

a trunk and a bottom which a biaxial stretching is given in a thinned-wall from a lower end of the neck portion;

a pair of base portions including a horizontal overhang piece formed in such a manner to project from both ends at symmetrical positions of side surfaces of the neck portion; and a pair of carrying handles formed in such a manner to connect with one end of each of the base portions and provided on a side of the neck portion, wherein each of said carrying handles includes a handle grip portion molded integrally and arm portions on both sides of said carrying handle, which is formed of a planar U-shape, the carrying handles are molded integrally with the neck portion when injecting a preform, said arm portions are longer than a distance from the base portions to an opening of the neck portion, and the respective arm portions of the carrying handles are connected to one corresponding end of each of the base portions, whereby the carrying handles flexibly extend sideward and across both sides of the neck portion from a connection region for said base portions and said arm portions are provided with a thinned-wall connection of a predetermined length, said pair of carrying handles are constituted on both sides of said neck portion in such a manner as to be bent freely upward and downward with respect to a perpendicular line through the center of the bottle and a pair of brackets are constituted across lower surfaces at both ends of said base portions and the side surfaces of the neck portion for preventing the base portions from deforming and breaking.

2. The biaxial stretching bottle having carrying handles according to claim 1, wherein upper surfaces near said connection region for said base portions are provided with a stopper comprising at least one projection corresponding to each of said carrying handles for limiting the respective carrying handles from bending beyond one side of said perpendicular line to an opposite side, said stopper coming into contact with the upper surfaces of said arm potions as said carrying handles are bent upward.

3. The biaxial stretching bottle having carrying handles according to claim 1, wherein upper surfaces of the arm portions at the connection of said carrying handles to said base portion are provided with a stopper comprising at least one projection corresponding to each of said carrying handles for limiting the respective carrying handles from bending beyond one side of said perpendicular line to an opposite side, said stopper coming into contact with the upper surfaces of said arm potions as said carrying handles are bent upward.

* * * * *